United States Patent [19]

Gamble

[11] 4,287,389

[45] Sep. 1, 1981

[54] HIGH-FIDELITY SPEAKER SYSTEM

[76] Inventor: George W. Gamble, One Phlox La., Acton, Mass. 01720

[21] Appl. No.: 44,171

[22] Filed: May 31, 1979

Related U.S. Application Data

[63] Continuation-in-part of Ser. No. 955,534, Oct. 30, 1978, Pat. No. 4,229,618.

[51] Int. Cl.[3] ..... H04R 3/00

[52] U.S. Cl. ..... 179/1 F; 179/1 A; 330/110

[58] Field of Search ..... 179/1 G, 1 GA, 1 F, 179/1 FS, 1 A; 330/110, 274, 282, 293, 294

[56] References Cited

U.S. PATENT DOCUMENTS

| | | | |
|---|---|---|---|
| 2,358,630 | 9/1944 | Fay | 179/1 F |
| 2,858,373 | 10/1958 | Hollman | 330/110 |
| 2,887,532 | 5/1959 | Werner | 179/1 F |
| 2,948,778 | 8/1960 | Clements | 330/110 |
| 3,525,812 | 8/1970 | Verbier | 179/1 F |
| 3,889,060 | 6/1975 | Goto et al. | 179/1 F |
| 4,107,620 | 8/1978 | Birman et al. | 179/1 F |
| 4,146,845 | 3/1979 | Lunquist | 179/1 A |
| 4,180,706 | 12/1979 | Bakgaard | 179/1 F |
| 4,229,619 | 10/1980 | Takahashi et al. | 179/1 F |

OTHER PUBLICATIONS

"Loudspeaker Feedback Circuit" G. Hibbert, IPC Electrical-Electronic Press *Wireless World* vol. 82, No. 1488 p. 54 Aug. 1976.

"Feedback-The Newest Old Idea in Speakers", *Audio Scene Canada* vol. 13 No. 3 p. 13 Mar. 1976, I. G. Masters.

*Primary Examiner*—Gerald L. Brigance

*Attorney, Agent, or Firm*—Russell & Nields

[57] ABSTRACT

A negative-feedback circuit for use with a moving-coil loudspeaker and a host amplifier modifies the feedback signal from the output of the host amplifier in such a say that the velocity of the voice coil of the speaker more closely follows the signal voltage input to the host amplifier. The power output of the power amplifier is delivered to the voice coil through a low resistance, and a high resistance feedback path is provided from each side of this low resistance to the input of the host amplifier. Other reactive, resistive and non-linear elements may also be used with the high resistance feedback paths for improved operation.

3 Claims, 7 Drawing Figures

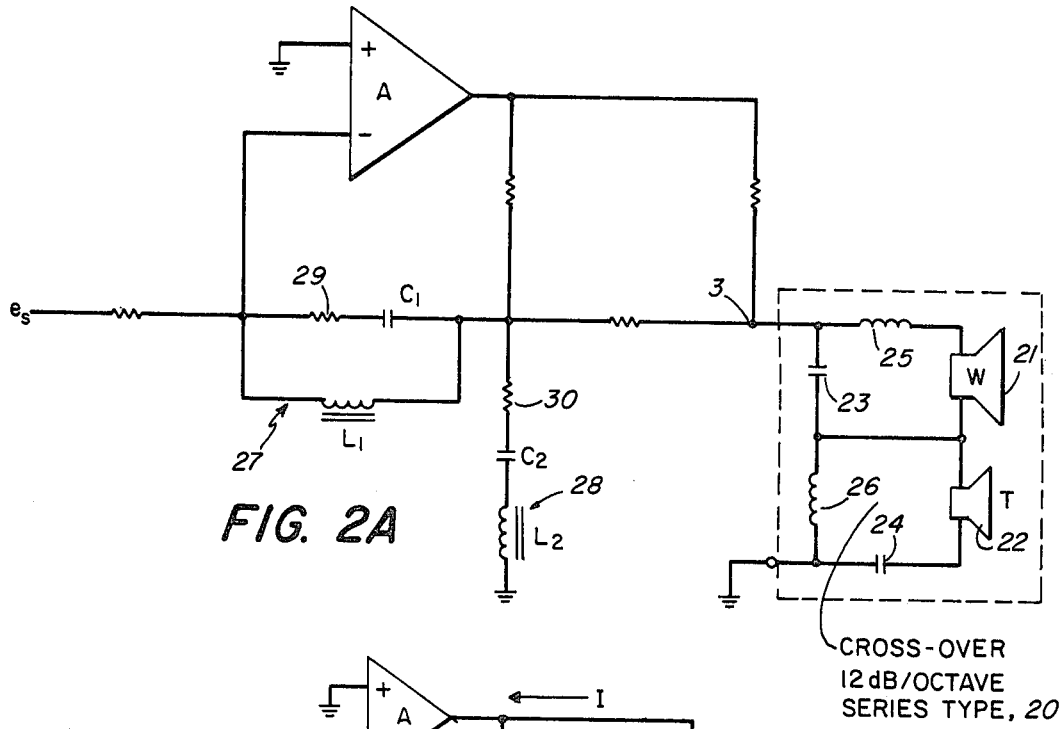
FIG. 2A
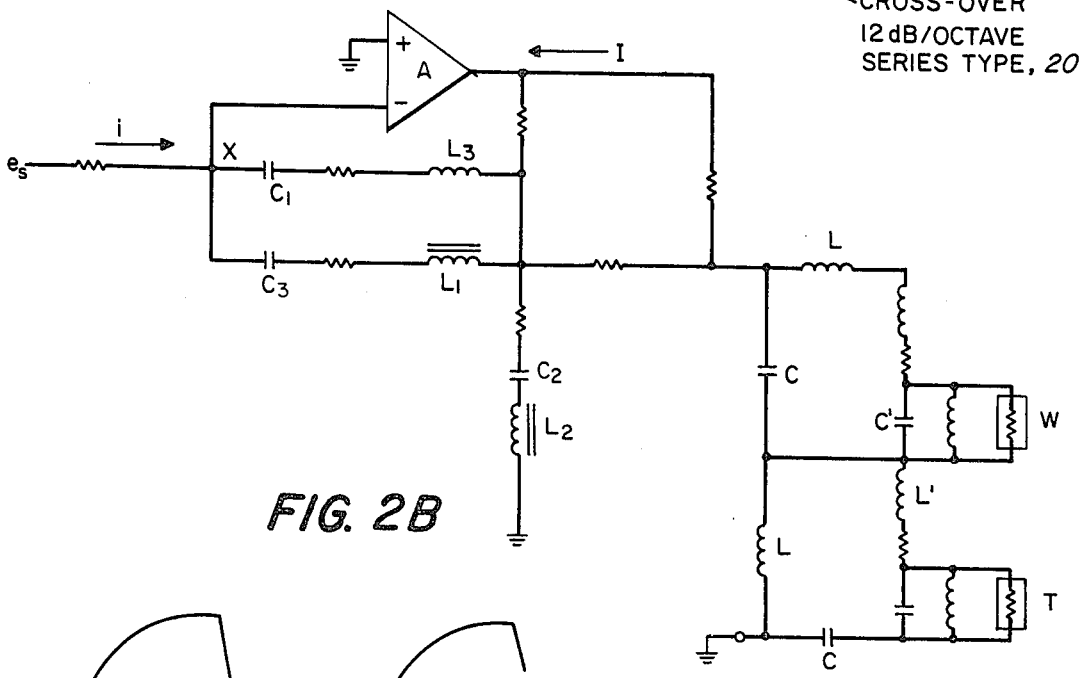
FIG. 2B
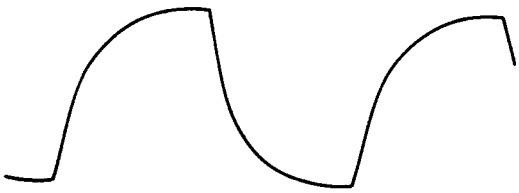
FIG. 4
FIG. 5
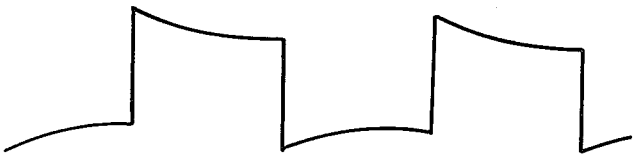

HIGH-FIDELITY SPEAKER SYSTEM

This is a continuation-in-part of my co-pending application, Ser. No. 955,534, filed Oct. 30, 1978, now U.S. Pat. No. 4,229,618.

BACKGROUND OF THE INVENTION

In an ideal sound reproducing system acoustical volume current corresponds to electrical signal current. In other words, velocity imparted to the air molecules at the surface of the speaker cone is directly proportional to the pressure that existed at the recording microphone. Engineers refer to such a system as linear i.e. output is a constant multiple of input. An ideal linear system reproduces signal without distortion.

Modern high-fidelity amplifiers are quite linear, producing perhaps one part distortion to a thousand parts of signal. Loudspeakers, on the other hand, fall far short of this performance and have been called the weakest link in the system. It would seem that further improvement of the power amplifier would be unproductive until speaker performance catches up. And this is not likely to happen.

As a practical consequence we find that a particular loudspeaker will sound the same when driven by a common program from a variety of amplifiers, but the reverse is not true. Different speakers driven by the same amplifier and program will sound quite different. While amplifier design has matured, innovation and new entries are common in the speaker industry, each attempting an improvement in linearity.

The causes of speaker deficiencies are complex, but these deficiencies subject the listener to dissonant combinations of tones that affect the listener by what has been referred to as "speaker fatigue". Many users prefer to advance the bass tone control on their equipment—a practice that tends to diminish this effect.

Much of the improvement in amplifier performance came about through the process of sampling its output to provide information with which to alter its input (feedback).

Attempts to do the same for the speaker have been frustrated because its output is not accessible but separated from the speaker terminals by the resistance of the voice-coil. This resistance is in series with the amplifier. It, therefore, is not possible to make a direct connection to the operating part of the speaker; this leaves the speaker free to display its own set of peculiar characteristics to color the sound, often very badly.

Over the past forty years various schemes have been devised to diminish the effects of voice-coil resistance, as evidenced by their patents, but none appear to be a commercial success. They employed electrical bridges, microphones, accelerometers, capacitors, etc. to monitor the output of the loudspeaker.

The bridge method recognizes that the speaker contains its own best velocity measureing device—the voice-coil acting as a generator. But eliminating the effects of the voice-coil resistance by this means is too brutal, causing a new set of disturbances.

SUMMARY OF THE INVENTION

The circuit of the invention electrically "listens" to the output of the speaker and provides this sample to alter the input to the power amplifier; diminishes but does not eliminate the voice-coil resistance and provides compensation for electrical and mechanical properties common to all loudspeakers.

With the circuit of the invention, listeners notice an unusual clarity and definition. Instruments appear in symphony recordings that were previously masked by noise. Transient response is improved and harshness eliminated. The circuit of the invention produces a more interesting, transparent sound. And finally, the difference in the sound from speakers of different manufacture is diminished.

There are economic advantages too.

It is simple, passive and contains few parts.

The industry can return to efficient bookshelf speakers and to lower powered amplifiers, reducing speaker construction cost and ending the power race.

Less power is needed for better fidelity in car stereo.

Electronic cross-over networks and water cooled voice-coils should not be necessary.

Output transistor protection circuits can be eliminated.

DETAILED DESCRIPTION OF THE PREFERRED EMBODIMENT

The invention may best be understood from the following detailed description thereof, having reference to the accompanying drawings, in which:

FIG. 2A is a circuit diagram explaining the operation of the circuit of FIG. 2;

FIG. 2B is another circuit diagram further explaining the operation of the circuit of FIG. 2;

FIG. 4 is a graph showing the output velocity of the voice-coil of a speaker driven by a conventional amplifier system with square-wave excitation;

FIG. 5 is a graph showing the voltage at the terminals of a speaker driven by a system embodying the invention with square-wave excitation.

Figure 1:
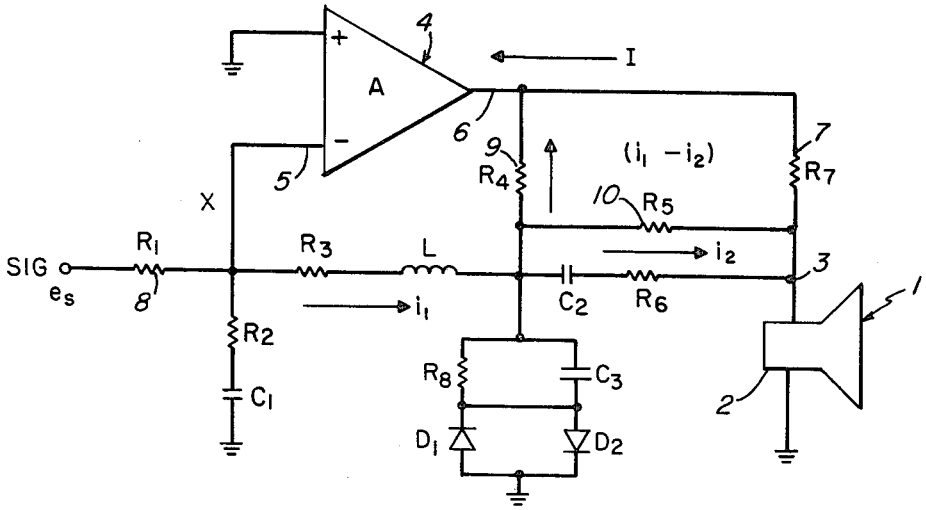
FIG. 1 is a simplified circuit diagram showing the principles of the invention.

Referring now to FIG. 1, therein is shown a simplified diagram of a high-fidelity speaker system embodying my invention. A moving-coil loudspeaker 1 having a voice coil 2 and a coil input terminal 3 is driven by an audio power amplifier 4 having a signal input terminal 5 and a power output terminal 6. The audio power amplifier is illustrated by the conventional symbol for an operational amplifier. The symbol is appropriate, because the invention is best used with an audio power amplifier of high current gain, high input impedance, and low output impedance. The output from the amplifier 4 is delivered to the loudspeaker 1 through a low output resistance 7 (shown as $R_7$ in FIG. 1) connected between the power output terminal 6 of the audio power amplifier 4 and the coil input terminal 3 of the loudspeaker 1.

The function of the high-fidelity speaker system shown in FIG. 1 is, of course, to produce sound which constitutes variations in pressure in the atmosphere corresponding as closely as possible to variations in the voltage of an audio voltage signal. The audio voltage signal is applied to the signal input terminal 5 of the amplifier 4 through an input resistance 8 (shown as $R_1$ in FIG. 1). I provide negative feedback from the power output terminal 6 to the signal input terminal 5 through an impedance network the impedance of which is dominated by a high feedback resistance 9 (shown as $R_4$ in FIG. 1), so that the voltage drop across the impedance network occurs primarily across the high resistance 9. This arrangement results, of course, in the conventional format for an inverting amplifier, and the output voltage V of the amplifier 4 closely approximates $-e_s(R_4/R_1)$.

In accordance with my invention I modify the negative-feedback signal so as to diminish but not eliminate the adverse effect of the voice-coil resistance and to provide compensation for electrical and mechanical properties of the speaker 1. To this end, I provide an impedance network the impedance of which is dominated by a leakage resistance 10 (shown as $R_5$ in FIG. 1), between a point near the input end of the high feedback resistance 9 and the coil input terminal 3 of the loudspeaker 1. In conventional operational amplifier circuitry, the voltage signal $e_s$ produces a current $i_1$ which flows through the input resistance 8 and the feedback resistance 9. The leakage resistance 10 diverts an amount of current $i_2$ the magnitude of which is a function of the voltage at the coil input terminal 3. As the output current I through the speaker 1 varies, and as the motional impedance of the speaker 1 varies, the voltage at the coil input terminal 3 varies (in magnitude and phase), thereby varying the leakage current $i_2$. This variation in the leakage current $i_2$ in turn produces a variation in the current $(i_1-i_2)$ flowing through the feedback resistance 9. This causes the feedback signal to vary, depending upon the output current I and upon the motional impedance of the speaker 1. By proper choice of components, including the addition of reactive elements and additional linear and non-linear resistive elements, the feedback signal can be caused to correct errors introduced by the voice-coil resistance, by the cross-over network and by the motional impedance of the speaker 1.

The resistor, $R_7$, allows measurement of the impedance of the speaker. This impedance is the sum of the voice-coil resistance, $R_{vc}$, and the motional-impedance of the speaker, $Z_m$. The voltage across the speaker terminals is then, $I(R_{vc}+Z_m)$. This voltage is connected through an impedance to the input of the amplifier (X) for negative feedback.

A second negative feedback mechanism is provided by the resistor $R_4$. The current, $i_2$, is related to $I(R_{vc}+Zm)$ while the current, $i_1$, is very nearly directly proportional to the signal voltage. The resistor, $R_4$, is much larger than all of the other impedances in the circuit making the output of (A) proportional to $R_4(i_1-i_2)$ or the difference between the signal voltage and the speaker voltage. This is negative feedback.

The speaker impedance $(R_{vc}+Z_m)$ is non-linear, having a component proportional to the current I. Accordingly, superimposed upon this second negative feedback mechanism is a nonlinear modification of the effective value of $i_1$ resulting from the non-linear behavior of the forward biased PN junctions of the signal diodes $D_1$ and $D_2$ in series with the parallel combination $R_8$, $C_3$. By this means the output current I is made to increase at a greater rate than the rate for the signal current $i_1$ for increasing signal current $i_1$ and vice-versa.

The value of the motional-impedance, $Z_m$, is equal to $e_v/I$ where $e_v$ is a voltage directly proportional to the velocity of the voice-coil. In fact $$e_v = BLv \tag{1}$$

where B, L and v are magnetic flux density, voice-coil wire length and voice-coil velocity respectively.

For some experimentally determined values of the components in the circuit the velocity of the voice-coil(v) can be made directly proportional to the signal voltage, $e_s$. This can be written;

$$v = \frac{\psi}{BL} e_s \psi = \text{CONSTANT} \tag{2}$$

If (2) is true then we have met the objective of making the output particle-velocity proportional to the sound pressure that was present at the recording microphone.

The voltage across the speaker terminals driven by a conventional amplifier (i.e. an amplifier which does not include my invention) will resemble a square wave if the input is square as its feedback arrangement tends to make the output voltage resemble the input—a constant voltage source.

The output velocity of the voice-coil when driven by such an amplifier should appear as in the graph of FIG. 4 as indicated by the equivalent circuit of a speaker. The lag being due to mass of the voice-coil assembly and its associated kinetic energy.

Measurements of the voltage across the speaker terminals of a system embodying the invention and including a host amplifier with square wave input look like the graph of FIG. 5. The curve shows that the circuit of the invention provides greater acceleration at signal changes than is possible for the conventional amplifier. The excess voltage is absorbed as an $IR_{vc}$ drop across the voice-coil resistance so that the voice-coil velocity-voltage, $e_v=IZ_m$, can approach square. This is the means by which the circuit reduces the effects of the voice-coil resistance for improved transient response. The host amplifier can be said to possess a negative output impedance.

The following analysis will show that for some choice of component values in the circuit the velocity-voltage $e_v=IZ_m$ can be directly proportional to the signal voltage, $e_s$, as we introduced as equation (2). This can be written:

$$e_v = \psi e_s$$

Assume, as in operational amplifier theory, that the point (X) in FIG. 1 is at ground potential. Then $i_1$ is very nearly equal to $e_s/R_1$ and is the signal current.

$$\frac{e_2}{R_1}(R_3 + R_5 + j\omega L) = IR_{vc} + e_v \tag{3}$$

The force of the voice-coil is proportional to the current through it. This force is opposed by the mass of the voice-coil assembly and acoustic damping. Hence:

$$F = BLI \tag{4}$$

and $$I = \frac{M}{BL} dv/dt + \frac{kv}{BL}$$

where t is time and M and k are mass and damping coefficient respectively. Substitute (4) in (3) and note that $v=e_v/BL$ and writing now in the differential form:

$$e_s\left[\frac{R_3+R_5}{R_1}\right]+\frac{L}{R_1}\frac{de_s}{dt}=\frac{MRvc}{(BL)^2}\frac{de_v}{dt}+\left[\frac{kRvc}{(BL)^2}+1\right]e_v \quad (5)$$

Integrate (5) with respect to time and assume that the constants of integration can be equal.

$$e_s\left[\frac{L}{R_1}+\left(\frac{R_3+R_5}{R_1}\right)t\right]=e_v\left[\frac{MRvc}{(BL)^2}+\left(\frac{kRvc}{(BL)^2}+1\right)t\right]$$

Now, if the electrical components can be chosen such that $$\frac{L}{R_1}=\psi\frac{MRvc}{(BL)^2} \text{ and } \frac{R_3+R_5}{R_1}=\psi\left[\frac{kRvc}{(BL)^2}+1\right] \text{ then } \frac{e_v}{e_s}=\psi$$

and $e_v=\psi e_s$ as we set out to demonstrate.

The magnitudes of M, B, L and k are unknown but the values of the components can be determined experimentally knowing that constants can be found that make (2) true.

The circuit of the invention is of the proper form to drive the motional-impedance of the loudspeaker directly and the negative feedback arrangement corrects errors in this motion.

Figure 2:
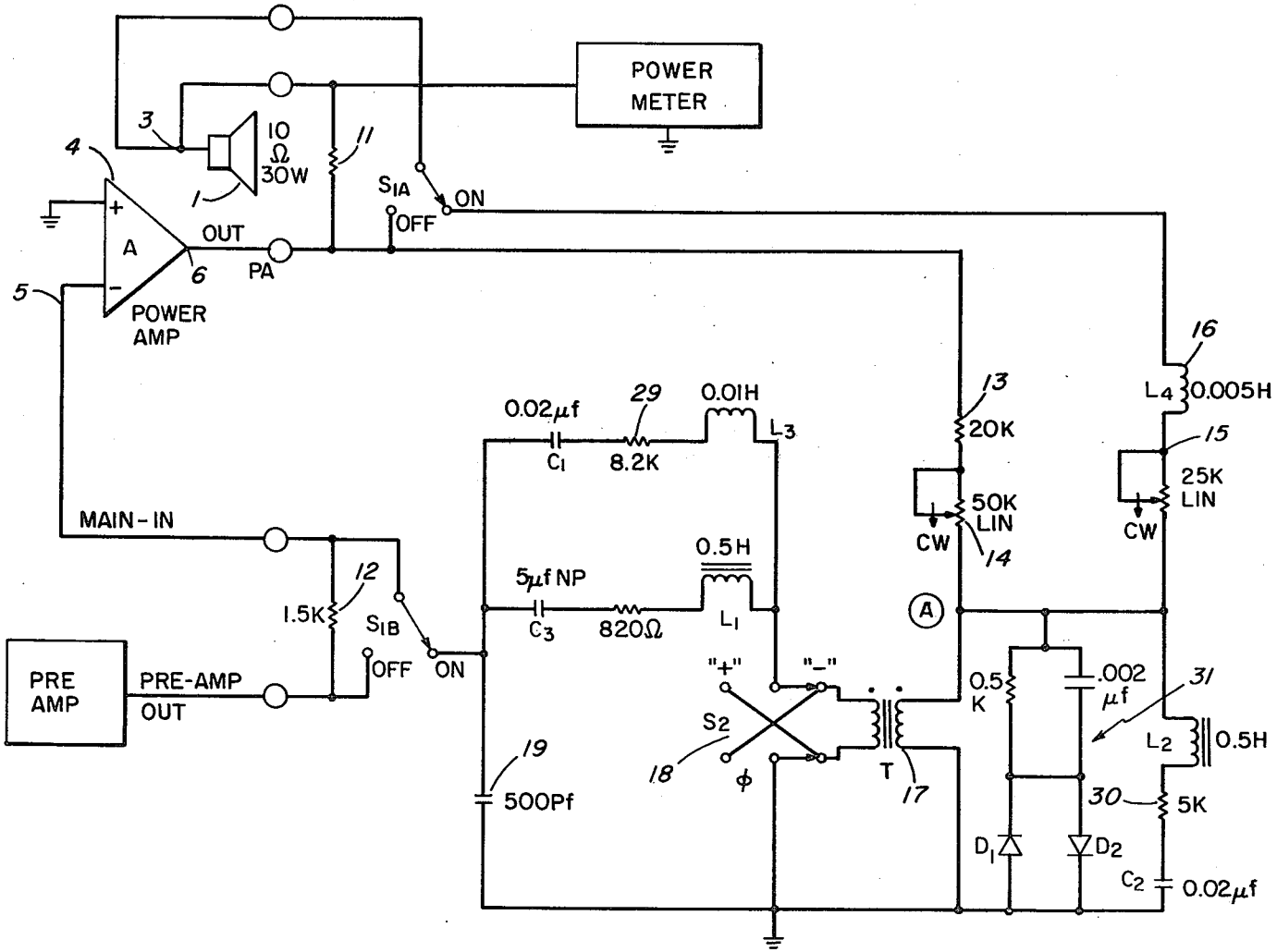
FIG. 2 is a circuit diagram of a preferred embodiment of the invention.

Referring now to FIG. 2, therein is shown a preferred form of circuit suitable for carrying out my invention. The elements shown in FIG. 2 correspond to those shown in FIG. 1 in the following manner. The low output resistance $R_7$ of FIG. 1 is shown at 11 in FIG. 2, and may be, for example, a 10-ohm, 30-watt resistor. The input resistance $R_1$ of FIG. 1 is shown at 12 in FIG. 2, and may be, for example, a 1.5-kilohm resistor. The high feedback resistance $R_4$ of FIG. 1 is shown in FIG. 2 at 13 and 14; the resistance 13 may be, for example, a 20-kilohm resistor, and the resistance 14 may be, for example, a 50-kilohm variable resistor. The leakage resistance $R_5$ of FIG. 1 is shown in FIG. 2 at 15 and 16; and may be a 25-kilohm variable resistor and a 5 millihenry inductor respectively.

The non-linear impedance branch elements $R_8$, $C_3$, $D_1$ and $D_2$ of FIG. 1 are shown in FIG. 2 at 31 and may be composed of a 500 ohm resistor, a 0.002 microfarad capacitor and two type 1N914 diodes respectively.

The amplifier 4 in FIG. 1 is shown as an inverting amplifier. However, the host amplifier may in fact not be inverting. Accordingly, in the circuit of FIG. 2 I have included a transformer 17 and a switch 18 associated therewith. The transformer 17 and its associated switch 18 are for phase reversal only and play no other part in the operation of the system. If the host amplifier is inverting these components may be omitted.

The capacitor shown at 19 in FIG. 2 bypasses currents at frequencies above the audio spectrum and may be, for example, a 500 picofarad capacitor.

This circuit of FIG. 2 also provides a separate and distinct conducting path from coil input terminal 3 to feedback components 15 and 16 so that the voltage fed back to these components is the actual value existing at terminal 3 and not contaminated by any IR drop in the cable to 3 from resistor 11.

The circuit of FIG. 2 also includes reactive elements which compensate for aberrations occurring near the cross-over frequency of loudspeakers equipped with a "woofer" and a "tweeter". In short, it is an object of my invention to provide in my negative feedback circuit a model of the loudspeaker. Although the circuit diagram of FIG. 2 shows one way of achieving this object, using passive elements, my invention includes other ways of achieving this object, such as the use of active elements like transistors and integrated circuits to form the reactances artificially.

A loudspeaker equipped with a "woofer" and a "tweeter" usually includes a crossover network having an inductance to keep high frequencies out of the woofer and a capacitance to keep low frequencies out of the tweeter. Two inductances and two capacitances are usually employed, with a crossover in the neighborhood of 1500 cycles per second. Accordingly, in order to compensate for aberrations near the crossover frequency, in the feedback circuit of FIG. 2 I have included two 0.5-henry inductances and two 0.02-microfarad capacitances and having a frequency response simpilar to the crossover network. In this way I include in the circuit an analog of a loudspeaker system, adapted to shape the frequency response of the overall circuit.

The manner in which the feedback network of the invention constitutes a model of a multi-way loudspeaker system is shown in more detail in FIG. 2A. Referring thereto, a loudspeaker having a typical series type 12 dB per octave, two-way cross-over network is shown at 20. Such a network is the one encountered most often in the loudspeaker market. The loudspeaker 20 includes a woofer 21 and a tweeter 22. The magnitude of each capacitor 23, 24 in the network and each inductance 25, 26 in the network can be determined from standard texts on the subject. Low frequencies applied to the coil input terminal 3 will be effectively blocked by the capacitors 23, 24 and shorted by the inductances 25, 26, so that the low frequency signal is applied only to the woofer 21. High frequencies applied to the coil-input terminal 3 will be effectively shorted by the capacitors 23, 24 and blocked by the inductances 25, 26, so that the high frequency signal is applied only to the tweeter 22. At the so-called cross-over frequency, the signal is shared by the woofer 21 and the tweeter 22, but typically there is a power loss of about 3 dB at this frequency. To compensate for this and its effects on phase, I make use of the fact that the cross-over frequency is nearly the same as the resonant frequency of a capacitor and an inductor having the capacitance and inductance, respectively, of the capacitor 23 (or 24) and the inductor 25 (or 26).

That is to say, reactive components are added to the basic feedback mechanism already described which components correspond to and compensate for the various actual and equivalent reactances existing between the two terminals of a multiway loudspeaker system. This is a necessary and sufficient condition for producing, in addition to improved cone-velocity accuracy, a flat frequency response from the system.

In FIG. 2A, each reactive pair comprising an inductance L and a capacitance C are resonant at the cross-over frequency of the loudspeaker netwrork. For a cross-over frequency of 1500 cycles, the reactive pair $L_1$ $C_1$ shown at 27 is parallel-resonant at 1500 cycles, and the reactive pair $L_2C_2$ shown at 28 is series-resonant at 1500 cycles. At the cross-over frequency, therefore, the parallel-resonant pair 27 adds a high impedance to the feedback path and the series-resonant pair 28 shunts off feedback current away from the amplifier input. This reduces the negative feedback and thereby increases the voltage across the speaker system at and near cross-over, thus recovering the loss of drive caused by the cross-over network at this frequency and accounting for its phase shift as well.

The resistances in the loudspeaker network (not shown) are conventionally such that the Q of such circuits approaches unity. Therefore, in order to be effective it is not necessary that the actual cross-over frequency and the simulated cross-over frequency (i.e. the resonant frequency of the reactive pairs 27, 28) be identically equal as long as they both reside within mid-range. Suitable resistances 29, 30 are included in the parallel-resonant pair 27 and series-resonant pair 28 in order to reduce the Q of these circuits to an appropriate value.

Referring back to FIG. 2, the capacitance $C_1$ and the inductance $L_1$ constitute the parallel-resonant pair 27 of FIG. 2A, and the capacitance $C_2$ and the inductance $L_2$ constitute the series-resonant pair 28 of FIG. 2A.

Referring now to FIG. 2B, therein is shown a more complete representation of the feedback network of the invention and includes the complete actual and equivalent components of a typical two-way speaker system. The impedance of each speaker is shown in the conventional way as including the inductance of the voice coil, the resistance of the voice coil, and the motional impedance wherein the effect of mass is represented by a capacitance, the effect of compliance is represented by an inductance, and the effect of radiation conductance and other losses is represented by a resistance.

At the mechanical resonant frequency of the woofer's mass-compliance combination, the woofer's power Output is excessive. Accordingly, I introduce in series with the inductance $L_1$ a capacitance $C_3$ which corresponds to the impedance due to the compliance of the woofer. Thus, $C_3$ and $L_1$ are series resonant near the mechanical resonant frequency of the woofer's mass-compliance combination, so that feedback is increased at this frequency, reducing drive at this mechanical resonance.

At the highest frequencies the inductance of the tweeter's voice coil reduces the drive to the tweeter motional impedance. In order to restore constant drive to the tweeter motional-impedance, I decrease (negative) feedback with increasing frequency by adding an inductance $L_3$ in series with the capacitance $C_1$ in the circuit containing parallel-resonant reactive pair 27. This effectively decreases the feedback signal by increasing the impedance of the parallel-resonant reactive pair 27 at high frequencies, since the inductance $L_1$ therein is already much greater than the inductance $L_3$. The inductance $L_3$ corresponds to the inductance of the tweeter's voice coil.

Referring back to FIG. 2, the capacitance $C_3$ constitutes the capacitance $C_3$ of FIG. 2B and may be a 5-microfarad non-polar condenser. It is series resonant with the 0.5 henry inductance $L_1$ near the mechanical resonant frequency of the woofer's mass-compliance combination. The inductance $L_3$ constitutes the inductance $L_3$ of FIG. 2B and may be a 10-millihenry inductance.

The circuit elements described in connection with FIGS. 2A and 2B thus have provided an analog or have "modeled" the essential elements of a multiway speaker system to cause the velocities of the voice-coils in such a system to approach the ideal condition in which the square-root of the sum of the squares of the velocities of the separate drivers in a multiway system is directly proportional to the program signal voltage. This ideal condition results in constant radiated energy with constant signal voltage over the audio spectrum.

As shown in FIGS. 1 and 2, my invention places a dynamic loudspeaker system in a negative feedback loop which includes the power amplifier and thereby reduces the distortion content and improves the transient response of its sound output.

The circuit accounts for or compensates for the effects of the self-impedance of the voice-coils and the cross-over network impedances to permit operation to be affected by the motional impedance of the drivers.

In the diagram of FIG. 2 the low output resistance 11 isolates the speaker 1 from the output of the power amplifier 4 to permit a measurement of the impedance of the speaker system, over the audio spectrum, part of which is the motional impedance.

There are two feedback paths; one from coil input terminal 3 of the speaker 1 through the leakage impedance 15, 16, the parallel network containing the inductances $L_1$, $L_3$, and then to the signal input terminal 5 of the power amplifier 4. The input resistance 12 isolates the pre-amp to allow feedback to be effective (pre-amplifier output impedance is normally less than 100 ohms). The other feedback path is from the output terminal 6 of the power amplifier 4 through the high feedback resistance 13, 14 where it meets the first path. Current through the high feedback resistance 13, 14 establishes the value of the voltage at the output of the amplifier. It is the difference between the other currents entering (and leaving) junction A. We have, then, a power amplifier output voltage which is a function of the difference between the voltage at the speaker and the input signal voltage i.e. negative feedback.

The circuit branch containing the inductance $L_3$ and the branch containing the inductance $L_1$ form a low Q parallel resonant circuit. The branch containing the inductance $L_2$ is a low Q series resonant circuit. Both are resonant at the cross-over frequency. A 5-kilohm resistor 30 establishes the Q of the branch containing the inductance $L_2$.

The capacitance $C_3$ and the inductance $L_1$ are series resonant at the natural resonant frequency of the woofer in its cabinet. It is low Q also.

The inductance $L_3$ and the capacitance $C_1$ are series resonant at about ten thousand hertz so that above this frequency branches 27 with the high feedback resistance 13, 14 form a differentiating network thereby compensating for the rising impedance of the tweeter voice-coil at the highest audio frequencies.

The on-off switch shorts the low output resistance 11 and the input resistance 12 eliminating operation according to the invention.

One could conclude that the invention must be tailored to a specific speaker because of the selection of the various resonance frequencies. Apparently the low Q circuits and the similarity of speakers all but eliminates this concern, for tests with a variety of speakers reveal similar results.

In summary we can make the general observation that the invention controls the amplitude and phase of the velocity of the drivers (voice-coils) in the speaker system by varying (over the audio spectrum) the magnitude and phase of the impedance in the negative feedback loop.

The objectives are to cause the square root of the sum of the squares of the velocities of the drivers, active in the cross-over region, to be proportional to the sound pressure at the recording microphone and to cause the phase and amplitude of the components of the original pressure wave to be preserved in voice-coil velocities outside of cross-over.

In general, the impedance of the feedback path correlates with the impedance of the speaker (i.e. models the speaker system) in the following way: If we exclude the motional-impedance the feedback impedance rises and falls with the speaker impedance. By speaker impedance we mean the total effect of the voice-coil impedances together with the cross-over impedances. The one exception is at the natural resonant frequency of the woofer at which the motional-impedance is high and the feedback impedance is low. This tracking of the speaker impedance was found necessary to produce a flat frequency response in the output of the speaker. When this necessary condition is fulfilled the normal workings of negative feedback in reducing "noise" in a control system operates to do the improving of the sound quality.

Figure 3:
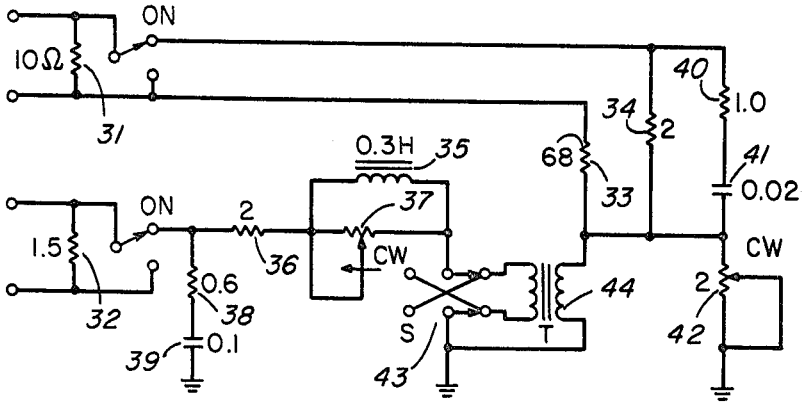
FIG. 3 is a circuit diagram of another embodiment of the invention.

FIG. 3 illustrates another embodiment of the invention. Referring thereto, the output resistance $R_7$ of FIG. 1 is shown in FIG. 3 as a 10-ohm resistor 31. The input resistance $R_1$ of FIG. 1 is shown in FIG. 3 as a 1.5-kilohm resistor 32. The high feedback resistance $R_4$ of FIG. 1 is shown in FIG. 3 as a 68-kilohm resistor 33. The leakage resistance $R_5$ of FIG. 1 is shown in FIG. 3 as a 2-kilohm resistor 34. The impedance network of which the feedback resistance is a part also includes an inductance 35 of 0.3 henries, a 2-kilohm resistor 36 in series therewith, and a 10-kilohm potentiometer 37 in parallel therewith. This 10-kilohm potentiometer provides some control over acceleration to balance frequency response—a tone control. A resistance 38 of 0.6 kilohms and a capacitance 39 of 0.1 microfarad provide one time constant, and a resistance 40 of 1 kilohm and a capacitance 41 of 0.02 microfarad provide another time constant. These time constants provide a cross-over function and are necessary because the mass of the tweeter is less than that of the woofer and the circuit would otherwise overdrive the tweeter.

The 2 kilohm potentiometer 42 provides control over the feedback factor and it too has some effect on frequency response, transient response and overall clarity of the sound.

The reversing switch 43 and transformer 44 in FIG. 3 can be eliminated if the smplifier is reversing.

Having thus described the principles of the invention, together with several illustrative embodiments thereof, it is to be understood that although specific terms are employed, they are used in a generic and descriptive sense, the scope of the invention being set forth in the following claims.

I claim:

1. High-fidelity speaker system comprising in combination a moving-coil loudspeaker having a voice coil and a coil input terminal an audio amplifier of high gain associated therewith, said audio amplifier having a signal input and a power output, a low resistance connecting said power output to said voice coil, an impedance network from said power output to said signal input, said impedance network including a dominating high resistance, said high resistance being between said power output and a junction point electrically near said signal input, and a leakage impedance between said junction point and said coil input terminal, said impedance network also including a non-linear element adapted to compensate for the non-linear properties of said loudspeaker.

2. System according to claim 1, wherein said non-linear element comprises a pair of PN junctions.

3. High-fidelity speaker system comprising in combination a moving-coil loudspeaker having a voice coil and a coil input terminal an audio amplifier of high gain associated therewith, said audio amplifier having a signal input and a power output, a low resistance and a speaker cable connecting said power output to said voice coil, an impedance network from said power output to said signal input, said impedance network including a dominating high resistance, said high resistance being between said power output and a junction point electrically near said signal input, a leakage impedance connected between said junction point and one end of a remote sensing cable which is connected at the other and directly to said coil input terminal so that the voltage fed back to said leakage impedance is the actual value existing at the coil input terminal, uncontaminated by the effect of the speaker cable.

* * * * *